US006136760A

United States Patent [19]

Koenitzer et al.

[11] Patent Number: 6,136,760

[45] Date of Patent: Oct. 24, 2000

[54] REDUCING LOW TEMPERATURE SCANNING BROOKFIELD GEL INDEX VALUE IN ENGINE OILS (LAW798)

[75] Inventors: Bernd A. Koenitzer; Christopher J. May, both of Sarnia, Canada

[73] Assignee: Exxon Research and Engineering Company, Florham Park, N.J.

[21] Appl. No.: 09/399,653

[22] Filed: Sep. 21, 1999

[51] Int. Cl.[7] ..... C10M 161/00

[52] U.S. Cl. ..... 508/467; 508/308

[58] Field of Search ..... 508/467

[56] References Cited

U.S. PATENT DOCUMENTS

| | | | |
|---|---|---|---|
| 2,921,027 | 1/1960 | Brennan | 252/32.7 |
| 3,729,296 | 4/1973 | Miller | 44/62 |
| 3,762,888 | 10/1973 | Kober et al. | 44/62 |
| 4,461,698 | 7/1984 | Briens et al. | 208/33 |
| 4,594,142 | 6/1986 | Achia et al. | 208/33 |
| 4,891,145 | 1/1990 | Brod et al. | 252/52 A |
| 4,957,650 | 9/1990 | Rossi et al. | 252/51.5 A |
| 5,011,505 | 4/1991 | Lewtas et al. | 44/393 |

FOREIGN PATENT DOCUMENTS

| | | |
|---|---|---|
| 0011497 | 2/1983 | European Pat. Off. . |

*Primary Examiner*—Ellen M. McAvoy

*Attorney, Agent, or Firm*—Joseph J. Dvorak; Joseph J. Allocca

[57] ABSTRACT

A lubricant composition containing both a dialkyl fumarate-vinyl acetate low temperature flow improver and sorbitan fatty acid ester or a polyoxyalkylene sorbitan fatty acid ester has reduced Gel Index.

10 Claims, No Drawings

REDUCING LOW TEMPERATURE SCANNING BROOKFIELD GEL INDEX VALUE IN ENGINE OILS (LAW798)

FIELD OF THE INVENTION

The present invention relates generally to lubricating oils having improved low temperature performance and more specifically to crankcase engine lubricants containing an additive combination to reduce Scanning Brookfield Gel Index.

BACKGROUND OF INVENTION

Lubricating oils, such as those used in the crankcase of internal combustion engines, are designed to reduce friction, minimize deposit formation, prevent corrosion and wear, and to ensure adequate engine lubrication over a wide temperature range. The American Petroleum Institute ("API"), Society of Automotive Engineers ("SAE"), American Society for Testing and Materials ("ASTM") and the International Lubricants Standardization and Approval Committee ("ILSAC") are the key bodies that define industry requirements for engine lubricant quality, establish classifications and develop test methods to certify that lubricants meet performance requirements. Individual original equipment manufacturers ("OEM's") often establish their own performance requirements that may be more stringent than those of API, SAE, ASTM or ILSAC requirements.

To insure that a lubricant has the appropriate low temperature properties generally three tests must be met. It must meet the requirements for pour point (ASTM D97), TP1 Mini Rotary Viscometer, "TP1MRV", (ASTM D 4648) and Scanning Brookfield Gel Index, "Gel Index", (ASTM D 5133). The pour point is an indication of dispensability at low temperatures while the TP1 MRV and Gel Index are measurements of lubricant pumpability at low temperatures.

Additives are used to formulate oil compositions that will meet the foregoing low temperature requirements. Unfortunately experience has shown that the TP1 MRV and Gel Index can vary independently of each other and that adjusting a lubricant composition to meet one of these properties often imposes a negative or undesirable effect on the other property.

Currently the industry requirements for a lubricant Gel Index is a maximum of 12 while the requirements for a lubricant TP1 MRV is a maximum of 60,000 cP at test temperature ranging from −10° C. to −40° C. depending upon the SAE grade. For example, a 5W-30 oil is tested at −35° C., 10W-30 at −30° C., and the like.

OEM's and lubricant formulators, of course, are continually seeking lubricant compositions that have properties that are better than the present standards. Thus, there remains a need for lubricating oils having reduced Gel Index values which still meet TP1 MRV and pour point requirements.

SUMMARY OF INVENTION

Surprisingly, it now has been found that the combination of a dialkylfumarate-vinyl acetate ("DFVA") copolymer flow improver and an ester selected from the group consisting of sorbitan fatty acid esters and polyoxyalkylene sorbitan fatty acid esters is effective in reducing the Gel Index of a lubricant below 12 without substantially increasing the TP1 MRV and pour point of the lubricant.

Accordingly, in one embodiment of the present invention there is provided a lubricating composition comprising a major amount of an oil of lubricating viscosity, a minor amount of a dialkylfumarate-vinyl acetate copolymer flow improver and an ester selected from the group consisting of sorbitan fatty acid esters or polyoxyalkylene sorbitan fatty acid esters, the DFVA and ester being present in an amount sufficient to lower the Gel Index of the composition to below about 12.

In another embodiment a method is provided to lower the Gel Index of a lubricating composition containing a major amount of a lubricating oil, the method comprising adding to the composition the combination of a DFVA copolymer flow improver and an ester selected from the group consisting of sorbitan fatty acid esters and polyoxyalkylene fatty acid ester in an amount sufficient to lower the Gel Index of the composition.

DETAILED DESCRIPTION OF THE INVENTION

The lubricating compositions of the present invention include a major amount of a base oil of lubricating viscosity, for example, in the range of about 13 to about 35 centistokes at 40° C. Indeed, any natural mineral base oil, hydrocracked and dewaxed base oils, wax isomerates, synthetic hydrocarbon oils such as polyalpha olefins or mixtures of these used in crankcase lubricating oils for spark ignited and compression ignited engines are suitable in the practice of the invention. Thus oils of API Groups I, II, III and IV or mixtures of these are suitable basestocks.

A lubricating composition of the present invention also includes a dialkylfumarate-vinyl acetate copolymer low temperature flow improver. In general the alkyl group in the DFVA will be in the range of 6 to 24 carbons and preferably 8 to 18 carbon atoms. The typical number average molecular weight of the DFVA useful is in the range of about 5,000 Mn to about 70,000 Mn. The DFVA flow improver generally is added to the lubricating composition in the form of a solution containing about 50% active ingredient. Typically the actual amount of DFVA present in the lubricant is in the range of from about 0.20 wt % to about 0.40 wt % based on the total weight of the lubricating composition.

The composition of the invention also includes a sorbitan fatty acid ester or a polyoxyalkylene sorbitan fatty acid ester including mono, di and triesters and mixtures thereof. In such esters the fatty acid typically will have alkyl chains of from about 10 to about 30 carbon atoms. The preferred fatty acid, however, is stearic acid and a preferred sorbitan ester is sorbitan tristearate. In the case where the ester is a polyoxyalkylene sorbitan ester the alkylene group in such esters typically is a $C_2$ to $C_{25}$ group and especially ethylene and the number of oxyalkylene units range from about 1 to about 20. Preferably the ester is a polyoxyethylene (20) sorbitan tristearate, especially when the base oil is a 150 N base oil.

The amount of sorbitan ester used in the lubricating compositions of the present invention is from about 0.20 wt % to 0.50 wt % based on the total weight of the composition.

The oil composition of the present invention may contain multi-functional additives of the types contained in modern oil formulations. These additives are usually not added independently, but are precombined in detergent-dispersant-inhibitor (DI) packages which can be obtained commercially from suppliers of lube oil additives. DI packages with a variety of ingredients, proportions and characteristics are available.

Optionally the oil composition may contain minor but effective amounts of antioxidants such as those used in contemporary motor oil formulations.

As will be readily appreciated the Gel Index of other fully formulated engine oils containing dialkylfumarate-vinyl acetate copolymer flow improvers can be lowered by adding sufficient polyoxyalkylene stearic acid esters to such oils.

EXAMPLES

The invention will now be illustrated by reference to the following examples and comparative examples.

Examples 1 to 3 and Comparative Examples 1 and 2

In these examples a formulated 5W-30 motor oil, hereinafter referred to as Oil A, was prepared by blending a solvent dewaxed 100N–150N mineral oil mix with 9.22 wt % of a DI package and 10.16 wt % of Paratone 8458 which is a trademark for a viscosity index improver and low temperature flow improver sold by Oronite Company, Richmond, Calif. Paratone 8458 consists of a copolymer VI improver and 3.5 wt % of a dialkylfumarate-vinyl acetate low temperature flow improver. As formulated Oil A contained 0.36 wt % DFVA.

To each of four samples of Oil A was added from 0.2 to 0.8 wt % of different sorbitan esters. The resulting mixtures were heated at 55° C. to 60° C. for about 30 minutes to dissolve the esters and then cooled to room temperature. The Gel Index and other inspections for each sample were performed. The results are given in Table 1 along with the inspections for Oil A (Comparative Example 1).

Comparative Examples 3 to 4

Following the procedure of Examples 1 to 3, Oil A was combined with 0.5 wt % of sorbitan monooleate and sorbitan sesquioleate. The inspections are given in Table 1.

TABLE 1

| | Comparative Example 1 | Example 1 | Example 2 | Example 3 | Comparative Example 2 | Comparative Example 3 | Comparative Example 4 |
|---|---|---|---|---|---|---|---|
| Oil A, wt % | 100.00 | 99.80 | 99.50 | 99.80 | 99.20 | 99.50 | 99.50 |
| Tween ® 610①, wt % | — | 0.20 | 0.50 | — | 0.80 | — | — |
| Tween ® 65②, wt % | — | — | — | 0.20 | — | | |
| Arlacel ® 83N③, wt % | — | — | — | — | — | 0.50 | — |
| Span ® 80④, wt % | — | — | — | — | — | — | 0.50 |
| Inspections | | | | | | | |
| Appearance | Bright & Clear | Bright & Clear | Bright & Clear | Bright & Clear | Cloudy | Bright & Clear | Bright & Clear |
| Gel Index (ASTM D5133) | 15.2 | 8.7 | 9.1 | 6.5 | 6.5 | 14.4 | 15.3 |
| MRV TP1 (−35° C.) Visc. cP | 26,000 | 29,300 | 39,200 | 26,700 | 88,152 | 26,200 | 25,000 |
| MRV TP1 Yield Stress Pa | Pass | Pass | Pass | Pass | Fail | Pass | Pass |
| Pour Point | −39° C. | | | −36° C. | | | |

①Tween ® 61 is a trade mark for a polyoxyethylene (4) sorbitan monostearate sold by ICI Americas Inc., Wilmington, Delaware.
②Tween ® 65 is a trademark for a polyoxyethylene (20)-sorbitan tristearate sold by ICI Americas Inc.
③Arlacel ® 83N is a trademark for a sorbitan sesquioleate sold by ICI America Inc.
④Span ® 80 is a trademark for a sorbitan monooleate sold by ICI Americas Inc.

Examples 4 to 5 and Comparative Examples 5 and 6

The procedure of Example 1 was followed except that a formulated 10W-30, hereinafter Oil B, was prepared by blending a 150N mineral oil with 9.22 wt % of the same DI package as Oil A but with 7.71 wt % of Paratone 8458. As formulated Oil B contained 0.27 wt % of DFVA. The inspections made are given in Table 2 and are compared to Oil B (Comparative Example 5).

TABLE 2

| | Comparative Example 5 | Example 4 | Example 5 | Comparative Example 6 |
|---|---|---|---|---|
| Oil B, wt % | 100.00 | 99.80 | 99.80 | 99.80 |
| Tween ® 61①, wt % | — | — | — | 0.20 |
| Tween ® 65②, wt % | — | 0.20 | — | |
| Span ® 65③, wt % | — | — | 0.20 | — |
| Inspections | | | | |
| Appearance | Bright & Clear | Bright & Clear | Bright & Clear | Bright & Clear |
| Gel Index (ASTMD 5133) | 13.4 | 6.4 | 7.9 | 13.9 |
| MRV TP1 (−30° C.) CP ASTM D4684 | 24600 | 27200 | | 29700 |
| Yield Stress, Pa | Pass | Pass | | Pass |

①, ② and ③ are all trademarks of ICI Americas.
①, ② See Table 1.
③ Span ® 65 is the trademark for a sorbitan tristearate sold by ICI Americas.

What is claimed is:

1. A lubricating composition comprising:

a major amount of an oil of lubricating viscosity;

a minor amount of a dialkylfumerate-vinyl acetate copolymer flow improver; and a minor amount of an ester selected from the group consisting of sorbitan fatty acid esters and polyalkylene sorbitan fatty acid esters;

wherein the composition without the ester has a Gel Index above 12, and wherein the dialkylfumerate-vinyl acetate and the ester are present in an amount sufficient to lower the Gel Index of the composition below about 12.

2. The composition of claim 1 wherein the dialkyl fumarate-vinyl acetate has a number average molecular weight, Mn, in the range of about 5,000 to about 70,000.

3. The composition of claim 1 wherein the ester is a polyoxyalkylene sorbitan fatty acid ester having alkylene groups of from 1 to 20 carbon atoms, and the fatty acid having alkyl groups of from 10 to 30 carbon atoms.

4. The composition of claim 1, wherein the ester is a sorbitan fatty acid ester and the acid having alkyl groups of from 10 to 30 carbon atoms.

5. The composition of claim 3 or 4 wherein the flow improver is present in amounts ranging from about 0.20 to about 0.40 wt % based on the weight of the composition and the ester is present in amounts ranging from about 0.20 wt % about 0.50 wt % based on the weight of composition.

6. A method for lowering the Gel Index of a lubricating composition containing a major amount of a oil, the method comprising:

adding to the composition both a dialkylfumarate-vinyl acetate flow improver and a sorbitan fatty acid ester or a polyoxyalkylene sorbitan fatty acid ester in an amount sufficient to lower the Gel Index of the composition.

7. The method of claim 6 wherein the flow improver is added in an amount ranging from about 0.20 wt % to about 0.40 wt % and the ester is added in an amount ranging from about 0.20 wt % to about 0.50 wt %, based on the weight of the composition.

8. In a lubricating composition containing a major amount of an oil of lubricating viscosity and a minor amount of a dialkylfumarate-vinyl acetate flow improver, the improvement comprising adding a sorbitan fatty acid ester or a polyoxyalkylene sorbitan fatty acid ester to the composition in an amount sufficient to lower the Gel Index below about 12.

9. The improvement of claim 8 wherein the lubrication composition contains about 0.20 to about 0.40 wt % of flow improvers and about 0.20 wt % to 0.50 wt % of ester is added.

10. The improvement of claim 9 wherein the acid of the ester has alkyl groups of from 10 to 30 carbon atoms and when the ester is a polyoxyalkylene sorbitan fatty acid ester said ester from 1 to about 20 oxyalkylene groups and said alkylene groups have from 2 to 25 carbon atoms.

* * * * *